US006925976B2

(12) United States Patent
Israel et al.

(10) Patent No.: US 6,925,976 B2
(45) Date of Patent: Aug. 9, 2005

(54) MODAL VARIABLE VALVE ACTUATION SYSTEM FOR INTERNAL COMBUSTION ENGINE AND METHOD FOR OPERATING THE SAME

(75) Inventors: Mark A. Israel, Amherst, MA (US); John P. Harttey, Blaine, WA (US)

(73) Assignee: Jenara Enterprises Ltd., Surrey (CA)

( * ) Notice: Subject to any disclaimer, the term of this patent is extended or adjusted under 35 U.S.C. 154(b) by 0 days.

(21) Appl. No.: 10/793,663

(22) Filed: Mar. 5, 2004

(65) Prior Publication Data

US 2004/0231639 A1 Nov. 25, 2004

Related U.S. Application Data

(60) Provisional application No. 60/452,019, filed on Mar. 6, 2003.

(51) Int. Cl.[7] ..... F02D 13/04; F01L 9/02

(52) U.S. Cl. ..... 123/90.12; 123/321; 123/90.16

(58) Field of Search ..... 123/90.12, 90.15, 123/90.16, 321, 568.14

(56) References Cited

U.S. PATENT DOCUMENTS

| | | | | | |
|---|---|---|---|---|---|
| 4,932,372 | A | * | 6/1990 | Meneely | 123/182.1 |
| 5,626,116 | A | * | 5/1997 | Reedy et al. | 123/321 |
| 5,692,469 | A | | 12/1997 | Rammer et al. | |
| 6,253,730 | B1 | * | 7/2001 | Gustafson | 123/321 |
| 6,334,429 | B1 | * | 1/2002 | Little, Jr. | 123/320 |
| 6,354,254 | B1 | | 3/2002 | Usko | |
| 6,422,186 | B1 | * | 7/2002 | Vanderpoel | 123/90.15 |
| 6,450,144 | B2 | * | 9/2002 | Janak et al. | 123/321 |
| 6,622,694 | B2 | * | 9/2003 | Mickiewicz et al. | 123/322 |
| 6,644,271 | B1 | * | 11/2003 | Cotton, III | 123/321 |
| 6,705,282 | B2 | * | 3/2004 | Hlavac | 123/322 |
| 2003/0019469 | A1 | * | 1/2003 | Mickiewicz et al. | 123/321 |
| 2004/0020467 | A1 | * | 2/2004 | Leman et al. | 123/467 |
| 2004/0237932 | A1 | * | 12/2004 | Persson | 123/321 |

FOREIGN PATENT DOCUMENTS

| | | |
|---|---|---|
| DE | 195 38 729 | 4/1997 |
| EP | 0 193 142 | 2/1985 |
| EP | 1 223 315 | 7/2002 |
| WO | WO 02/086300 | 10/2002 |

OTHER PUBLICATIONS

Ratinaud, F. "Les freins moteurs," Dossier v. 2415 pp. 30–36, Mar. 1999.

* cited by examiner

*Primary Examiner*—Hai Huynh
(74) *Attorney, Agent, or Firm*—Berenato, White & Stavish, LLC

(57) ABSTRACT

A variable valve actuation system for providing discrete exhaust and intake valve lift profiles for various operating modes of an internal combustion engine. The variable valve actuation system includes exhaust and intake rocker assemblies, exhaust and intake hydraulic extension devices operatively coupling corresponding rocker assemblies with respective engine valves and exhaust and intake control valves for selectively supplying the pressurized hydraulic fluid to the extension devices so as to independently switch them between a pressurized condition and a depressurized condition. The engine further includes an exhaust brake provided to initiate a small lift of the exhaust valve during the engine braking operation while the exhaust extension device maintains the exhaust valve open during a compression stroke for bleeder-compression release braking. The exhaust and intake valves can be adjusted independently to provide combinations of valve lift modes.

25 Claims, 4 Drawing Sheets

Fig. 2
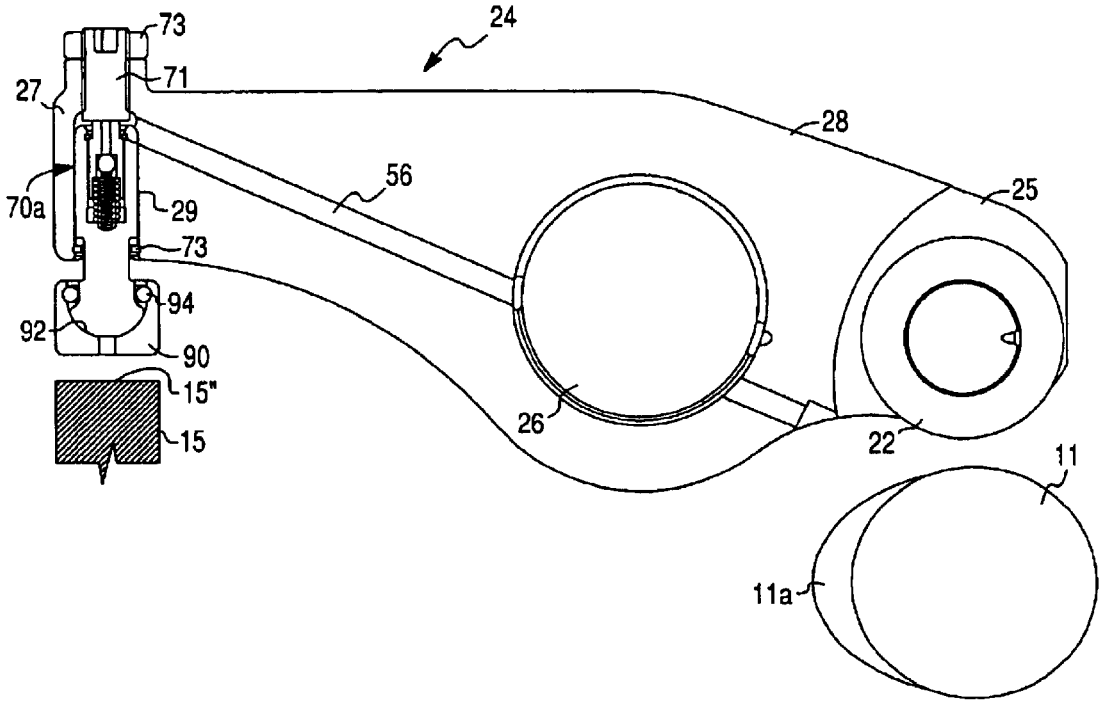
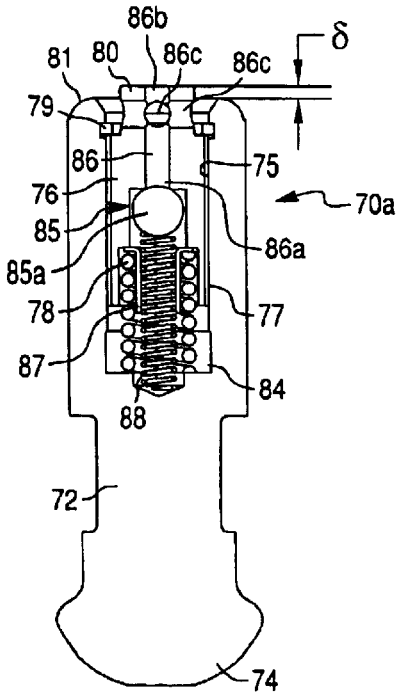
Fig. 3

MODAL VARIABLE VALVE ACTUATION SYSTEM FOR INTERNAL COMBUSTION ENGINE AND METHOD FOR OPERATING THE SAME

CROSS-REFERENCE TO RELATED APPLICATION

This Application claims the benefit under 35 U.S.C. 119(e) of U.S. Provisional Application No. 60/452,019 filed Mar. 6, 2003 by Mark A. Israel et al.

BACKGROUND OF THE INVENTION

1. Field of the Invention

The present invention relates to apparatuses and methods for controlling actuation of valves of internal combustion engines in general, and, more particularly, to a variable valve actuation system adapted to provide various operating modes of an internal combustion engine including compression release engine braking.

2. Description of the Prior Art

Most commercially available automotive engines operate with fixed valve lift profiles to provide for fresh air intake and exhaust gas discharge. This fixed lift, duration and timing of the valve events results in compromise among the competing performance factors of engine power density, fuel economy and exhaust emissions. Many benefits can be realized if the valve events are made variable and optimized for particular operating modes of the engine.

The two-mode system of Bhargava et al. (U.S. Pat. No. 6,092,496) opens the intake valve during the exhaust stroke during warming-up of the engine. This directs a portion of the hot exhaust gas to the intake manifold, which mixes with the incoming fresh air and provides a warmer charge to the cylinder during the main intake stroke. This mode is invoked whenever a sensed engine associated temperature falls below a predetermined threshold level.

The valve control apparatus of Meneely et al. (U.S. Pat. No. 6,314,926) operates by means of dynamic lash adjustment to engage with one or two lobes on a cam profile. One lobe is to actuate the main intake or exhaust event. For the exhaust, the second lobe may be a compression release lift profile for engine braking. When the engine brake mode is on, the main exhaust opening is also advanced. Provision is specifically made to disengage the lash adjustment before the main exhaust achieves full lift, thereby returning the system to a normal exhaust valve opening and a normal valve overlap with the intake valve opening. Since the main exhaust valve opening (EVO) is advanced only when in engine braking mode, advantage cannot be taken of the early EVO during positive power to enhance turbocharger turbine response.

Usko (U.S. Pat. No. 6,354,254) has developed rocker assemblies to modify valve lift and timing. Two main rockers are used for positive power modes. Full exhaust valve lift (EVL) includes an opening during the intake stroke for internal exhaust gas recirculation (EGR). Reduced EVL eliminates the EGR opening. Full intake valve lift (IVL) increases valve overlap and reduced valve lift gives an early valve closing. In this system, the lash adjustment means to change operating mode for the engine is limited to two positions. The EGR provided for positive power is not compatible with engine braking, so a braking lobe cannot be included on the exhaust cam profile. A third rocker is required to provide engine braking, with a cam dedicated for this process. It includes a compression release lobe and another lobe for exhaust gas recirculation during braking, called brake gas recirculation (BGR). This extra mechanism and cam takes up valuable space in the engine and is a significant added cost.

Many approaches have been taken to develop variable valve actuation with infinite adjustment means. These systems necessarily use electronic controls to optimize the intake and exhaust valve lift profiles, based on demand from the engine. These control systems represent added complexity and cost in return for some extra fine-tuning of specific engine processes. Simko (U.S. Pat. No. 5,161,497) describes a method for phase shifting the exhaust and intake events to reduce pumping losses and improve exhaust emissions. Mikame (U.S. Pat. No. 6,244,230) developed a workable phase shifting system with dual camshafts. Another mechanical variable valve actuation (VVA) system, by Nakamura (U.S. Pat. No. 6,390,041), does not shift the phase of the valve openings, but has the ability to change the valve opening magnitude from full lift to zero lift. Opening and closing points for exhaust and intake events can be varied, centered on constant crank angle timing of the peak lifts.

For internal combustion engines, especially diesel engines, engine braking is an important feature for enhanced vehicle safety. Compression release engine brakes open the exhaust valve(s) prior to Top Dead Center (TDC) of the compression stroke. This creates a blow-down of the compressed cylinder gas and the energy used for compression is not reclaimed. The result is engine braking, or retarding, power. A conventional engine brake has substantial cost associated with the hardware required to open the exhaust valve(s) against the extremely high load of a compressed cylinder charge. The valve train components must be designed and manufactured to operate reliably at high mechanical loading. Also, the sudden release of the highly compressed gas comes with a high level of noise. In some areas, engine brake use is not permitted because of the loud noise, establishing a potential safety hazard.

Exhaust brakes can be used on engines where compression release loading is too great for the valve train. The exhaust brake mechanism consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

While known valve actuation systems, including but not limited to those discussed above, have proven to be acceptable for various vehicular driveline applications, such devices are nevertheless susceptible to improvements that may enhance their performance and cost. With this in mind, a need exists to develop improved variable valve actuation systems and driveline apparatuses that advance the art, such as a modal variable valve actuation system that can provide two or more modes of operation for the exhaust valves and for the intake valves, in order to optimize a range of processes in an internal combustion engine. A practical system will use step-wise switching and will not incur the high cost and reliability issues of high-speed actuators and their associated electronic controls. Engine braking must be provided as an integral feature for internal combustion (I.C.) engines and not require additional valve actuation apparatus.

The engine brake will incorporate a quiet process to be useful in environments sensitive to noise pollution and will operate with reduced mechanical loading on the engine. The valve lift modes for powering the engine will provide the benefits of enhanced power density and fuel economy and improved exhaust emissions for targeted ranges of engine operation.

SUMMARY OF THE INVENTION

The present invention provides an improved variable valve actuation system and a method for controlling the same.

According to one aspect of the invention, a variable valve actuation system is provided for operating at least one exhaust valve of an internal combustion (I.C.) engine during a positive power operation and an engine braking operation. The I.C. engine includes at least one cylinder, an exhaust brake and a bleeder-compression release brake. The variable valve actuation system of the present invention comprises an exhaust rocker assembly for operation of the at least one exhaust valve, an exhaust hydraulic extension device operatively coupling the exhaust rocker assembly with the at least one exhaust valve for controlling a lift and a phase angle thereof, a source of a pressurized hydraulic fluid in fluid communication with the exhaust hydraulic extension device, and an exhaust control valve provided to selectively supply the pressurized hydraulic fluid from the source to the exhaust hydraulic extension device so as to switch the exhaust hydraulic extension device between a pressurized condition when the pressurized hydraulic fluid is supplied to the exhaust hydraulic extension device and a depressurized condition when the pressurized hydraulic fluid is not supplied to the exhaust hydraulic extension device. The exhaust brake is provided to generate an exhaust backpressure sufficient to cause the at least one exhaust valve to open near bottom dead center of the intake stroke of the engine during the engine braking operation, while the exhaust hydraulic extension device in the pressurized condition provided to maintain the at least one exhaust valve open during a compression stroke for bleeder-compression release braking.

In accordance with the exemplary embodiments of the present invention, the variable valve actuation system is provided for operating both exhaust and intake valves of the I.C. engine. Accordingly, the valve actuation system further comprises an intake rocker assembly for operation the intake valve, an intake hydraulic extension device operatively coupling the intake rocker assembly with the intake valve for controlling a lift and a phase angle thereof, and an intake control valve provided to selectively supply the pressurized hydraulic fluid from the source to the intake hydraulic extension device so as to switch the intake hydraulic extension device between a pressurized condition when the pressurized hydraulic fluid is supplied to the intake hydraulic extension device and a depressurized condition when the pressurized hydraulic fluid is not supplied to the intake hydraulic extension device. In this embodiment, the exhaust and intake valves can be adjusted independently to provide combinations of valve lift modes.

According to another aspect of the invention, there is a method for controlling the variable valve actuation system for operating at least one exhaust valve of an internal combustion engine during a positive power operation and an engine braking operation. The method of the present invention comprises the following steps. First, a demanded operating mode is determined. If a braking operation is demanded then the variable valve actuation system opens the exhaust control valve to set the exhaust hydraulic extension device in the pressurized condition, adjusts the exhaust brake to generate an exhaust backpressure sufficient to cause the at least one exhaust valve to open near a bottom dead center of the intake stroke of the engine and maintains the at least one exhaust valve open during the compression stroke when the engine performs the engine braking operation. However, if positive power operation is demanded then the system determines a lift and phase angle of the at least one exhaust valve demanded. Subsequently, the system opens the exhaust control valve to set the exhaust hydraulic extension device in the pressurized condition if an extended lift and phase angle of the at least one exhaust valve is demanded, or closes the exhaust control valve to set the exhaust hydraulic extension device in the depressurized condition if a reduced lift and phase angle of the at least one exhaust valve is demanded.

Therefore, the variable valve actuation system of the present invention is capable of selectively and independently adjusting a valve lift profile of engine intake and exhaust valves in a plurality of operating modes during both a positive power operation and an engine braking operation and provide the bleeder-compression release braking during the engine braking operation. The variable valve actuation system of the present invention offers significant advantages over the prior art. Compared to conventional compression release brakes, it does not require the additional dedicated expensive hardware necessary to open exhaust valves against the extremely high load of the compressed cylinder charge. However, at low engine speeds engine braking is enhanced because an exhaust restrictor is closed a sufficient amount to maintain a pressure that causes the exhaust valve to open, and thereby enhance operation of the bleeder-compression release brake at low engine speeds as well. Moreover the invention provides a low-cost engine braking system, which can be integrated into overall engine design. Mechanical and thermal components of the engine are not overloaded since the exhaust restrictor can be adjusted below predetermined maximum temperature and pressure values. Moreover, the variable valve actuation system of the present invention enhances power density and fuel economy, and improves exhaust emissions, while being relatively simple and inexpensive in manufacturing.

BRIEF DESCRIPTION OF THE DRAWINGS

Other objects and advantages of the invention will become apparent from a study of the following specification when viewed in light of the accompanying drawings, wherein:

FIG. 2 is a sectional view of an exhaust rocker assembly in accordance with the first exemplary embodiment of the present invention;

FIG. 3 is a sectional view of a hydraulic extension device of the exhaust rocker assembly in accordance with the first exemplary embodiment of the present invention;

DETAILED DESCRIPTION OF PREFERRED EMBODIMENTS

The preferred embodiments of the present invention will now be described with reference to accompanying drawings.

Figure 1:
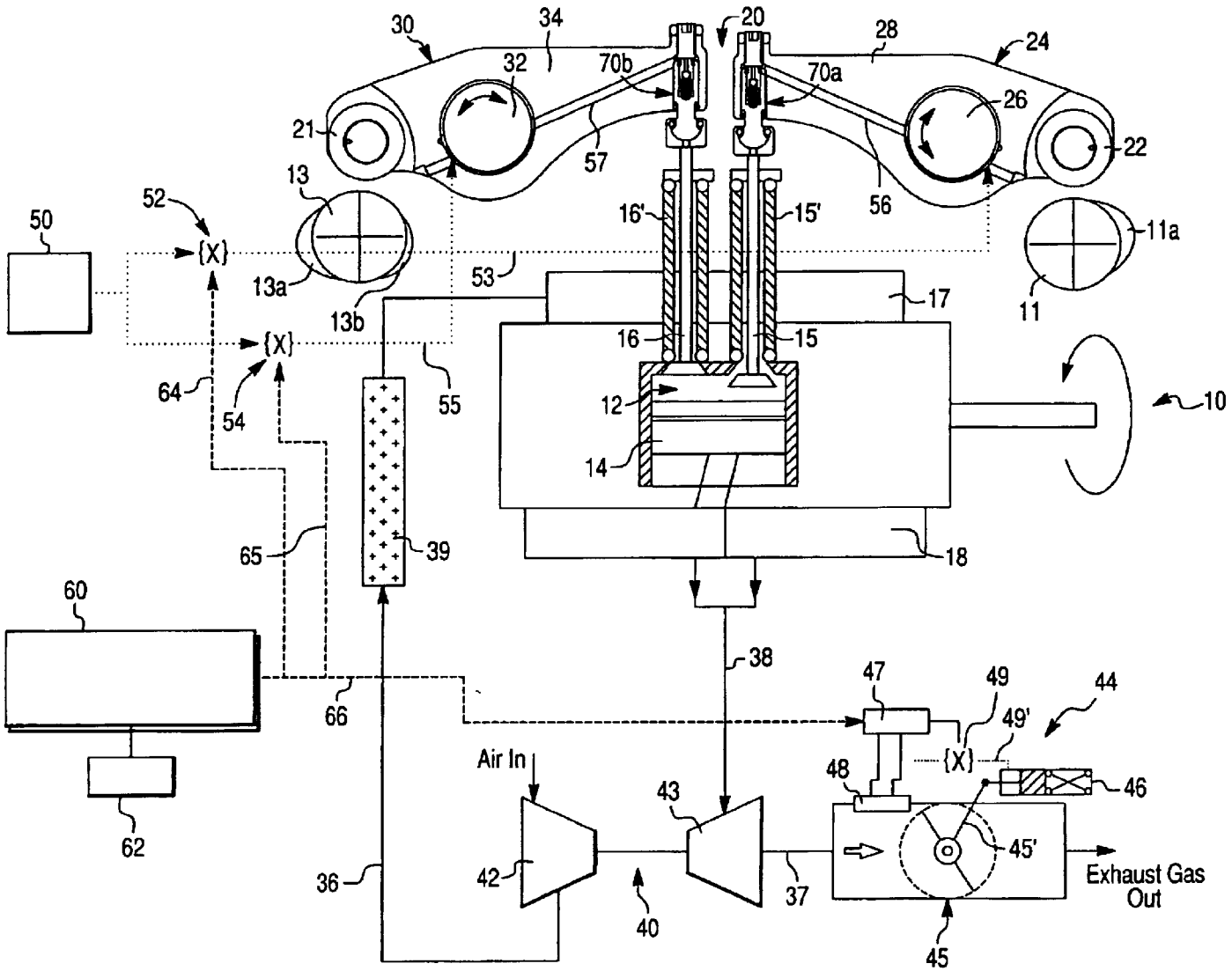
FIG. 1 is a schematic view showing an internal combustion engine equipped with a variable valve actuation system according to a first exemplary embodiment of the present invention.

FIG. 1 schematically depicts a variable valve actuation system 20 of an internal combustion (I.C.) engine 10, preferably a four-stroke diesel engine, comprising a plurality of cylinders. However, for the sake of simplicity, only one cylinder 12 is shown in FIG. 1. Each cylinder 12 is provided with a piston 14 that reciprocates therein. Each cylinder 12 further includes an exhaust valve 15 and an intake valve 16 each provided with a return spring 15' or 16', respectively, and a valve train provided for lifting and closing of the exhaust and intake valves 15 and 16. It will be appreciated that each cylinder 12 may have more than one intake valve and/or exhaust valve, but again only one of each is shown for simplicity. The engine also has an intake manifold 17 and an exhaust manifold 18 both in fluid communication with the cylinder 12.

The valve train of the present invention includes the variable valve actuation system 20 and two spaced cam members: an exhaust cam member 11 and an intake cam member 13. The variable valve actuation system 20 comprises an exhaust rocker assembly 24 mounted about an exhaust rocker shaft 26 and provided to open the exhaust valve 15, and an intake rocker assembly 30 mounted about an intake rocker shaft 32 and provided to open the intake valve 16.

The diesel engine 10 further comprises a turbocharger 40 including a compressor 42 and a turbine 43, and a variable exhaust brake 44 fluidly connected to the turbocharger 40 through an exhaust passage 37. As illustrated in FIG. 1, the compressor 42 is in fluid communication with the intake manifold 17 through an intake conduit 36, while the turbine 43 is in fluid communication with the exhaust manifold 18 through an exhaust conduit 38. Conventionally, the exhaust gases from the exhaust manifold 18 rotate the turbine 43 and exit the turbocharger 40 through the exhaust passage 37 into the exhaust brake 44. In turn, ambient air compressed by the compressor 42 is carried by the intake conduit 36 to the intake manifold 17 through an intercooler 39 where the compressed charge air is cooled before entering the intake manifold 17. The charge air enters the cylinder 12 through the intake valve 16 during an intake stroke. During an exhaust stroke, the exhaust gas exits the cylinder 12 through the exhaust valve 15, enters into the exhaust manifold 18 and continues out through the turbine 43 of the turbocharger 40.

As illustrated in FIG. 1, the exhaust brake 44 of the first exemplary embodiment of the present invention is located downstream of the turbocharger 40. However, the location of the exhaust brake 44 is not limited to downstream of the turbine 43 or to the form of a conventional exhaust brake. Alternatively, the exhaust brake 44 may be placed upstream of the turbocharger 40 (the turbine 43). Where the exhaust brake 44 is installed upstream of the turbocharger 40, advantage is taken by generating a high-pressure differential across the turbine 43. This drives the turbocharger compressor 42 to a higher speed and thereby provides more intake boost to charge the cylinder for engine braking.

In accordance with the present invention illustrated in FIG. 1, the exhaust brake 44 includes a variable exhaust restrictor in the form of a butterfly valve 45 operated by an exhaust brake actuator 46. Preferably, the butterfly valve 45 is rotated by linkage 45' connected to the exhaust brake actuator 46 in order to adjust the exhaust restriction, thus the amount of exhaust braking. The exhaust brake actuator 46 of the present invention may be of any appropriate type known to those skilled in the art, such as a fluid actuator (pneumatic or hydraulic), an electromagnetic actuator (e.g. solenoid), an electromechanical actuator, etc. Preferably, in this particular example, the exhaust brake actuator 46 is a pneumatic actuator, although, as noted above, other actuating devices could be substituted.

In the first exemplary embodiment of the present invention the exhaust brake 44 is a Microprocessor Controlled Exhaust Brake as disclosed in PCT Publication No. WO 02/086300 to Anderson et al., which is incorporated herein by reference. However, it will be appreciated that any other appropriate exhaust brake may be employed, and that any throttling device may be used as the exhaust restrictor, including a highly restrictive turbocharger. The turbocharger 40 may be a variable wastegate or a variable geometry type. The exhaust restrictor may be placed before or after the turbocharger turbine.

The exhaust brake actuator 46 is controlled by a microprocessor 47. The microprocessor 47 controls the variable exhaust restrictor 45, thus the amount of exhaust braking, based on the information from a plurality of sensors 48 including, but not limited, an pressure sensor and a temperature sensor sensing pressure and temperature of the exhaust gas flowing through the exhaust restrictor 45 of the exhaust brake 44. It will be appreciated by those skilled in the art that any other appropriate sensors, may be employed. The pneumatic actuator 46 is operated by a solenoid valve 49 provided to selectively connect and disconnect the pneumatic actuator 46 with a pneumatic pressure source (not shown) through a pneumatic conduit 49' in response from a control signal from the microprocessor 47.

As further illustrated in FIG. 1, the exhaust cam members 11 corresponds to the exhaust rocker assembly 24, while the intake cam members 13 corresponds to the intake rocker assembly 30. Moreover, both the exhaust rocker assembly 24 and the intake rocker assembly 30 include hydraulic extension devices 70*a* and 70*b*, respectively, for selectively controlling a valve lash of the corresponding exhaust and intake valves 15 and 16. In fact, each of the hydraulic extension device 70*a* and 70*b* is a hydraulically expandable linkage that is integrated into the valve train of the I.C. engine.

The exhaust rocker assembly 24, as shown in FIGS. 1 and 2, comprises an exhaust rocker lever 28 rotatably mounted on the exhaust rocker shaft 26. A first end 25 of the exhaust rocker lever 28 includes an exhaust cam lobe follower 22. The exhaust cam lobe follower 22 preferably is adapted to contact an exhaust cam lobe 11*a* of the exhaust cam member 11. In the first exemplary embodiments illustrated in FIGS. 1 and 2, the hydraulic extension device 70*a* is installed at a second end 27 of the exhaust rocker lever 28 so that the hydraulic extension device 70*a* is disposed adjacent to the exhaust valve 15. However, it will be appreciated that the hydraulic extension device 70*a* is effective when placed at any position in the exhaust valve train. A fluid channel 56 is provided within the exhaust rocker lever 28 in order to provide a fluid communication between the hydraulic extension device 70*a* and a source 50 of a pressurized hydraulic fluid shown in FIG. 1. The hydraulic extension device 70*a* is described in detail below.

Similarly, as shown in FIG. 1, the intake rocker assembly 30 comprises an intake rocker lever 34 rotatably mounted on the intake rocker shaft 32. A first end of the intake rocker lever 34 includes an intake cam lobe follower 21. The intake cam lobe follower 21 preferably is adapted to contact an intake cam lobe 13*a* of the intake cam member 13. Again, in the first exemplary embodiment illustrated in FIGS. 1 and 2, the hydraulic extension device 70*b* is disposed at a second end of the intake rocker lever 34 so that the hydraulic extension device 70*b* is disposed adjacent to the intake valve 16. However, it will be appreciated that the hydraulic extension device 70*b* is effective when placed at any position in the intake valve train. A fluid channel 57 is provided within the intake rocker lever 34 in order to provide a fluid communication between the hydraulic extension device 70*b* and the source 50 of the pressurized hydraulic fluid.

Preferably, the exhaust and intake rocker assemblies 24 and 30 and respective hydraulic extension devices 70*a* and 70*b* are substantially identical. Thus, only the exhaust rocker assembly 24 and its respective hydraulic extension device 70*a* are shown in detail in FIGS. 2 and 3. It will be appreciated that alternatively only the exhaust rocker assembly 24 may be provided with the hydraulic extension device.

The hydraulic extension device 70*a* in accordance with the first exemplary embodiment of the present invention comprises a lower lifter body 72 reciprocatingly mounted within a cylindrical bore 29 in the second end 27 of the exhaust rocker assembly 24 and held therein by a retainer ring 73. The lower lifter body 72 has a ball-like end 74 received in a socket 92 of an exhaust valve interface member 90 adapted to contact a top face 15" of the exhaust valve 15 to form a swivel joint that maintains flat contact with the top face 15" of the engine valve 15. There is a retaining ring 94 that holds the lower lifter body 72 and the interface member 90 together.

The exhaust rocker assembly 24 is further provided with an adjusting screw 71 that forms the upper interface for the hydraulic extension device 70*a* and permits manual adjustment of the valve lash, or free-play, in an exhaust valve train. The lower lifter body 72 has an internal bore 75 that receives an upper lifter body 76. The upper lifter body 76 is adapted to reciprocate within the lower lifter body 72 between an expanded position and a collapsed position. A radial clearance 77 is provided between the upper lifter body 76 and the internal bore 75 in the lower lifter body 72. The hydraulic extension device 70*a* further comprises a retaining ring 79 fitted within the bore 75 and provided to limit upward movement of the upper lifter body 76 from the point of view of FIGS. 2 and 3. A coil spring 78 biases the upper lifter body 76 upwardly from the point of view of FIGS. 2 and 3 against the retaining ring 79 to an expanded position of the hydraulic extension device 70*a*. Moreover, the upper lifter body 76 has a protrusion 80 which extends above a top face 81 of the lower lifter body 72 by a distance $\delta$ when the upper lifter body 76 is in its expanded position, as shown in FIG. 3. The protrusion 90 is sized to extend through the retaining ring 79.

The hydraulic extension device 70*a* further defines a variable volume hydraulic chamber 84 formed within the lower lifter body 72 behind (below) the upper lifter body 76, as illustrated in FIG. 3. The upper lifter body 76 of the hydraulic extension device 70*a* further includes a supply conduit 86 formed longitudinally through the upper lifter body 76 including an exit opening 86*a* and at least one intake opening. Preferably, as illustrated in detail in FIG. 3, the supply conduit 86 has a top intake opening 86*b* and side intake openings 86*c*. The supply conduit 86 provides fluid communication between the hydraulic chamber 84 of the hydraulic extension device 70*a* and the fluid channel 56 within the exhaust rocker lever 28, thus between the hydraulic chamber 84 and the source 50 of the pressurized hydraulic fluid. Preferably, the source 50 of the pressurized hydraulic fluid is in the form of an oil pump (not shown) of the diesel engine 10. Correspondingly, in this exemplary embodiment, an engine lubricating oil is used as the working hydraulic fluid. It will be appreciated that any other appropriate source of the pressurized hydraulic fluid and any other appropriate type of fluid will be within the scope of the present invention.

A check valve 85 is incorporated into the upper lifter body 76 to isolate the hydraulic chamber 84. Preferably, the check valve 85 includes a substantially spherical ball member 85*a* provided to seal against the exit opening 86*a* in the supply conduit 86. Preferably, the ball member 85 is biased against the exit opening 86*a* in the supply conduit 86 by a coil spring 88. A collar 87 fitted between the springs 78 and 88 within the upper lifter body 76 may be used to guide the check valve spring 88.

The variable valve actuation system 20 of the present invention further includes an exhaust control valve 52 and an intake control valve 54. As illustrated in FIG. 1, the exhaust control valve 52 is provided to selectively fluidly connect the source 50 of the pressurized hydraulic fluid to the hydraulic extension device 70*a* of the exhaust rocker assembly 24 through an exhaust valve fluid passageway 53 and the fluid channel 56 in the exhaust rocker lever 28. Similarly, the intake control valve 54 is provided to selectively fluidly connect the source 50 of the pressurized hydraulic fluid to the hydraulic extension device 70*b* of the intake rocker assembly 30 through an intake valve fluid passageway 55 and the fluid channel 57 in the intake rocker lever 34.

Preferably, the exhaust and intake control valves 52 and 54 are substantially identical. Each of them is operated by an electromagnetic (preferably, solenoid) actuator electronically controlled by an electronic controller 60, which may be in the form of a CPU or a computer. The electronic controller 60 operates the exhaust and intake control valves 52 and 54 based on the information from a plurality of sensors 62 representing engine and vehicle operating parameters as control inputs, including, but not limited to, an engine speed, an engine load, an engine operating mode, etc. It will be appreciated by those skilled in the art that any other appropriate sensors, may be employed.

The electronic controller 60 is programmed to provide signals 64 and 65 to solenoid control valves 52 and 54 to cause them to selectively and independently open or close based on operating demand of the engine 10. When the exhaust control valve 52 is open, hydraulic fluid, such as engine oil, is provided to the hydraulic extension device 70*a* of the exhaust rocker assembly 24. When the intake control valve 54 is open, the hydraulic fluid is provided to the hydraulic extension device 70*b* of the intake rocker assembly 30. Correspondingly, when either solenoid valve 52 or 54 is closed, no hydraulic fluid is supplied to the hydraulic extension device (70*a* or 70*b*) of the corresponding rocker assembly (24 or 30). In this way, the exhaust valve 15 and the intake valve 16 are controlled independently to generate valve lift profiles for optimized engine operation. The electronic controller 60 also provides a signal 66 to the microprocessor 47 of the exhaust brake 44. When the engine 10 is operating in engine brake mode, the control signal 66 adjusts the variable exhaust restrictor 45 in order to maintain a desired exhaust backpressure.

The operation of the variable valve actuation system 20 is described in detail below for the exhaust rocker assembly 24.

When the exhaust control valve 52 is closed, the hydraulic extension device 70*a* is in the depressurized condition that provides a positive valve lash as no hydraulic fluid is supplied to the hydraulic extension device 70*a* of the exhaust rocker assembly 24 and the hydraulic chamber 84 is not filled with the pressurized hydraulic fluid. In such a condition, the upper lifter body 76 is supported in the lower lifter body 72 only by the biasing spring 78 so that the protrusion 80 of the upper lifter body 76 extends above the top face 81 of the lower lifter body 72 and the hydraulic extension device 70*a* fills the gap between the interface member 90 of the exhaust rocker assembly 24 and the top face 15" of the exhaust valve 15. Consequently, when the exhaust cam member 11 rotates the exhaust rocker lever 28 and the exhaust valve interface member 90 presses the exhaust valve 15, the adjusting screw 71 of the rocker lever 28 pushes the protrusion 80 of the upper lifter body 76 of the hydraulic extension device 70*a* and compresses the biasing coil spring 78 without causing the exhaust valve 15 to open due to the counteracting resilient force of the valve spring 15', which is substantially stronger than the biasing spring 78, and/or gas pressure within the cylinder 12. Only when the spring 78 is compressed so that the protrusion 80 of the upper lifter body 76 retracts within the lower lifter body 72, the adjusting screw 71 of the rocker lever 28 acts directly upon the top face 81 of the lower lifter body 72 of the hydraulic extension device 70*a* and causes the exhaust valve 15 to open. Thus, the distance δ to which the protrusion 80 extends above the top face 81 of the lower lifter body 72 provides the certain positive valve lash. Consequently, due to the valve lash provided by hydraulic extension device 70*a* in the depressurized condition, the valve opening is retarded and valve closing is advanced, and the amount of the valve lift is reduced. In other words, when the hydraulic extension device 70*a* is in the depressurized condition, it provides a reduced valve actuation, i.e. a reduced lift and phase angle of the engine valve.

On the other hand, when the exhaust control valve 52 is opened, the hydraulic extension device 70*a* is in the pressurized condition that provides a zero valve lash as the pressurized hydraulic fluid from the source 50 fills the hydraulic chamber 84 of the hydraulic extension device 70*a* through the supply conduit 86 and the check valve 85. As long as the hydraulic fluid pressure supplied by the source 50 is greater than the hydraulic pressure in the chamber 84, the ball 85*a* of the check valve 85 moves away from the exit opening 86*a* of the supply conduit 86 against the biasing force of the coil spring 88 to allow hydraulic fluid into the chamber 84. When the pressurized hydraulic fluid is supplied through the supply conduit 86, the hydraulic extension device 70*a* expands to a preset length so that the protrusion 80 of the upper lifter body 76 extends above the top face 81 of the lower lifter body 72 by an amount δ to its expanded position. It will be appreciated that in the expanded position of the upper lifter body 76, the hydraulic extension device 70*a* fills the gap between the interface member 90 of the exhaust rocker assembly 24 and the top face 15" of the exhaust valve 15. Once the pressure of the hydraulic fluid in the chamber 84 is equal to or greater than the supply hydraulic fluid pressure, the ball 85*a* of the check valve 85 hydraulically locks the chamber 84 and the upper lifter body 76 is held firmly in place. The radial clearance 77 is a flow path for the hydraulic fluid to leak out of the hydraulically locked chamber 84. This radial clearance 77 is designed to allow the hydraulic fluid to leak out at a predetermined rate in a controlled manner over the duration that the axial load is applied to the exhaust valve 15 as required in the engine brake operation of the variable valve actuation system 20 of the present invention. Any amount of the hydraulic fluid that leaks out of the chamber 84 through the clearance 77 during valve actuation is refilled on each subsequent engine cycle during the time that the valve is not being actuated. When the hydraulic fluid is not supplied to the chamber 84 through the supply conduit 86, the hydraulic fluid lost from the chamber 84 by way of the clearance 77 is not refilled on subsequent engine cycles.

As a result, when the exhaust cam member 11 rotates the exhaust rocker lever 28 and the exhaust valve interface member 90 presses the exhaust valve 15, the adjusting screw 71 of the rocker lever 28 pushes the protrusion 80 of the upper lifter body 76 of the hydraulic extension device 70*a*. As the pressurized hydraulic fluid is locked in the chamber 84 by the check valve 85, the biasing coil spring 78 is practically not compressed by the rocker lever 28 and the adjusting screw 71 acts directly upon the top face 81 of the protrusion 80 of the upper lifter body 76 of the hydraulic extension device 70*a* causing the exhaust valve 15 to open. Thus, due to the zero valve lash provided by hydraulic extension device 70*a* in the pressurized condition, the valve opening is advanced and valve closing is retarded, and the extended valve lift is realized. In other words, when the hydraulic extension device 70*a* is in the pressurized condition, it provides an extended valve actuation, i.e. an extended lift and phase angle of the engine valve.

It will be appreciated that the operation of the intake rocker assembly 30 of the variable valve actuation system 20 is substantially identical to the operation of the exhaust rocker assembly 24. It will also be appreciated that each of the hydraulic extension devices 70*a* and 70*b* may actuate multiple exhaust or intake valves by operating on a bridge component that indexes the valves in unison.

Figure 4:
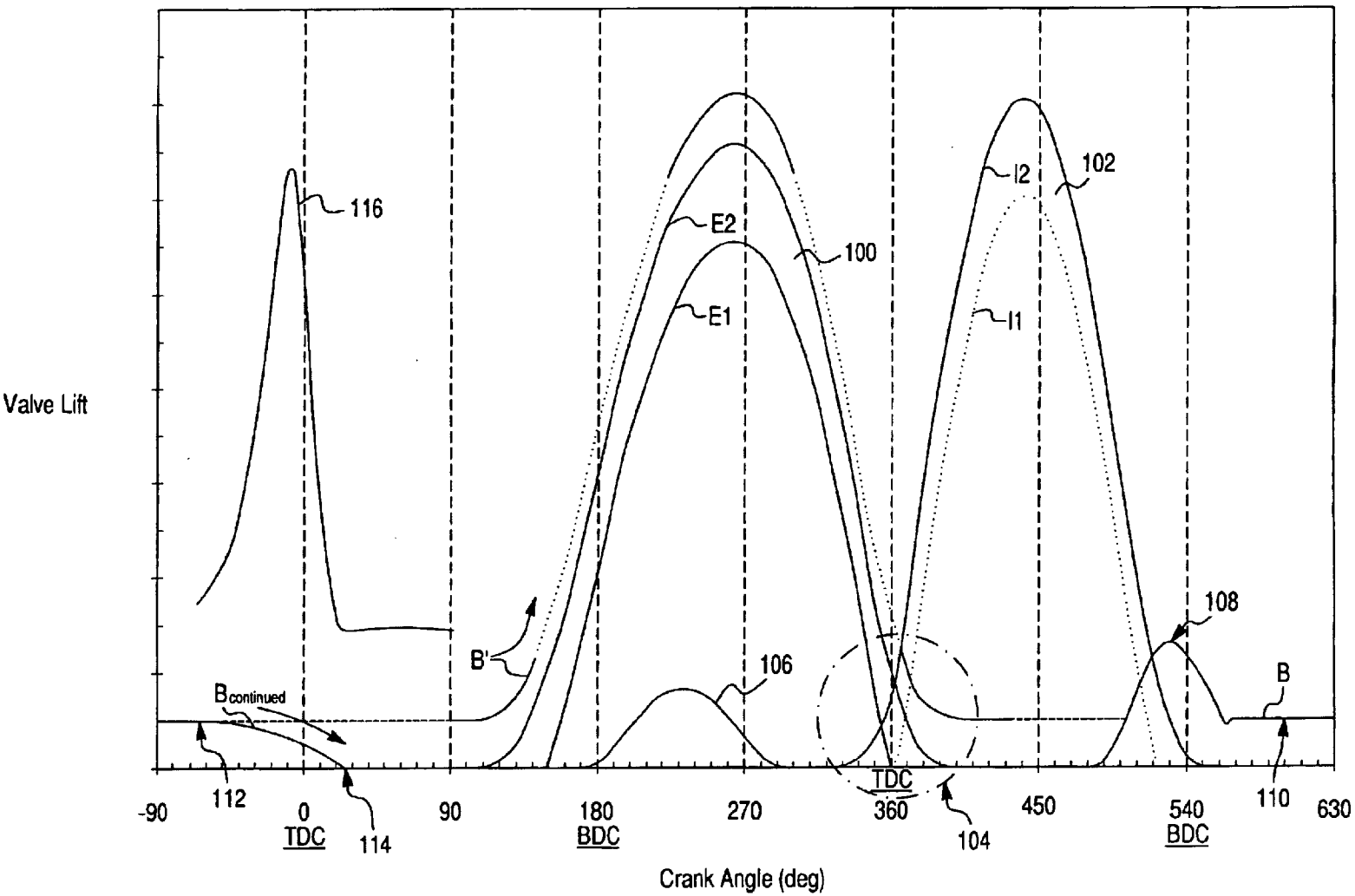
FIG. 4 is a timing diagram showing valve lift profiles for various operating modes of the internal combustion engine equipped with the variable valve actuation system in accordance with the present invention.

In operation, the variable valve actuation system 20 of the present invention allows the internal combustion engine 10 to operate in a number of different operating modes as illustrated in FIG. 4 by selectively providing discrete exhaust and intake valve lift profiles for various modes of operation of the I.C. engine. More specifically, the present invention provides at least four operating modes during a positive power operation and at least two operating modes during an engine braking operation provided by operating the exhaust and intake hydraulic extension device 70*a* and 70*b* of the variable valve actuation system 20 independently in various combinations. It should be noted that the valve lift modes are achieved by operating on a centered valve lift control. That is, both the beginning and end of the valve events are modified concurrently. As valve lash is increased, valve opening is retarded and valve closing is advanced. The opposite occurs when valve lash is reduced.

During positive power operation, the variable exhaust restrictor 45 of the exhaust brake 44 shown in FIG. 1 remains open. Depending on operating demand of the I.C. engine 10, the exhaust valve 15 is provided with an extended lift E2 or a reduced lift E1. Similarly, the intake valve 16 is provided with an extended lift I2 or a reduced lift I1. The cam lobes 11*a* and 13*a* of exhaust and intake cam members 11 and 13, respectively, are translated into the valve lift profiles by operating the hydraulic extension device 70*a* and 70*b* of the variable valve actuation system 20 in either pressurized or depressurized condition. In the depressurized condition, reduced valve lift profiles are produced. In the pressurized condition, extended valve lift profiles are produced. The intake cam member 13 may be designed with an additional lobe 13*b* that reopens the intake valve during the main exhaust stroke 100. This provides exhaust gas recirculation (EGR).

Therefore, based on the operating demand of the I.C. engine 10, the following operating modes of the variable valve actuation system 20 of the present invention during the positive power operation may be provided:

1. Operating Mode E1-I1. In this mode the electronic controller 60 closes both the exhaust control valve 52 and the intake control valve 54 to turn off the supply of the pressurized hydraulic fluid to both of the hydraulic extension devices 70*a* and 70*b*, thus setting the hydraulic extension devices 70*a* and 70*b* to the depressurized condition. This provides reduced lift and phase angle for both the exhaust valve 15 during the exhaust stroke 100 and the intake valve 16 during the intake stroke 102, as shown by lines E1 (for the exhaust valve 15) and I1 (for the intake valve 16) in FIG. 4. This operating mode provides minimum valve overlap 104 of exhaust valve closing with intake valve opening and is useful for partial load operation of the I.C. engine 10 to reduce losses at the overlap 104 and end portions of intake regions. This operating mode effectively increases the compression ratio of the I.C. engine, which increases cylinder temperature and enhances starting of a cold engine.

2. Operating Mode E2-I2. In this mode the electronic controller 60 opens both the exhaust control valve 52 and the intake control valve 54 to turn on the supply of the pressurized hydraulic fluid to both of the hydraulic extension devices 70*a* and 70*b*, thus setting the hydraulic extension devices 70*a* and 70*b* to the pressurized condition. A check valve 85 hydraulically locks the chamber 84, thus firmly holding the hydraulic extension devices 70*a* and 70*b* in the extended position when an axial load is applied. The radial clearance 77 between the extendable upper lifter body 76 and the lower lifter body 72 is designed to leak in a controlled manner over the duration that the axial load is applied. During the positive power operation, the valves 15 and 16 are opened against relatively low cylinder pressure and the leakage of the hydraulic fluid from the chamber 84 is relatively small and is recovered on every engine cycle, thus resetting the hydraulic extension devices 70*a* and 70*b* before the next engine cycle.

Consequently, the Operating Mode E2-I2 provides extended lift and phase angle for both the exhaust valve 15 during the exhaust stroke 100 and the intake valve 16 during the intake stroke 102, as shown by lines E2 (for the exhaust valve 15) and I2 (for the intake valve 16) in FIG. 4 as the hydraulic extension devices 70*a* and 70*b* provide the zero valve lash. As further illustrated in FIG. 4, this Mode E2-I2 provides largest valve overlap 104 of exhaust valve closing with intake valve opening and yields maximum gas exchange. This provides for an internal exhaust gas recirculation (EGR) that effectively reduces Nitrous Oxide (NOx) emissions by limiting combustion temperature. Late intake valve closing reduces the effective compression ratio by allowing a portion of the cylinder charge to escape in the early part of the compression stroke. This also leads to cooler combustion temperature and reduced NOx emissions. Late intake valve closing also effectively increases the expansion ratio with a possibility to increase power density with provision of additional air and fuel. The Mode E2-I2 also provides early exhaust valve opening for enhanced turbine transient response.

As noted above, EGR may also be provided with the additional lobe 13*b* on the intake cam 13 that reopens the intake valve 16 at 106 during the exhaust stroke 100, as shown in FIG. 4. Exhaust gas passes through the cylinder 12 to the intake manifold 17 and mixes with the incoming air. This provides a main source of EGR for reducing NOx emissions. If less EGR is desired, the intake valve is shifted to Mode I1 where cam lobe 13*b* does not translate motion to open the intake valve and this source of EGR is not provided.

3. Operating Mode E2-I1. In this mode the electronic controller 60 opens the exhaust control valve 52 and closes the intake control valve 54 to turn on the supply of the pressurized hydraulic fluid to the hydraulic extension device 70*a* and turn off the supply of the pressurized hydraulic fluid to the hydraulic extension device 70*b*, thus setting the hydraulic extension device 70*a* to the pressurized condition, while setting the hydraulic extension device 70*b* to the depressurized condition. Consequently, the Operating Mode E2-I1 provides extended lift and phase angle for the exhaust valve 15 and reduced lift and phase angle for the intake valve 16, as shown by lines E2 (for the exhaust valve 15) and I1 (for the intake valve 16) in FIG. 4. This provides early exhaust valve opening, which improves the turbocharger turbine response. In turn, late intake valve opening reduces gas exchange loss in the overlap region 104 with the exhaust valve closing, which improves part load performance and fuel economy. Early intake valve closing is also provided, which further limits gas exchange loss. In this operating mode, the additional cam lobe 13*b* of the intake cam 13 does not translate motion to open the intake valve 16 to provide the EGR event as the hydraulic extension device 70*b* is in the depressurized condition that provides the valve lash which is larger that the profile of the EGR cam lobe 13*b*.

4. Operating Mode E1-I2. In this mode the electronic controller 60 closes the exhaust control valve 52 and opens the intake control valve 54 to turn off the supply of the pressurized hydraulic fluid to the hydraulic extension device 70*a* and turn on the supply of the pressurized hydraulic fluid to the hydraulic extension device 70*b*, thus setting the hydraulic extension device 70*a* to the depressurized condition, while setting the hydraulic extension device 70*b* to the pressurized condition. Consequently, the Operating Mode E1-I2 provides reduced lift and phase angle for the exhaust valve 15 and extended lift and phase angle for the intake valve 16, as shown by lines E1 (for the exhaust valve 15) and I2 (for the intake valve 16) in FIG. 4. This mode can be invoked after the I.C. engine is started to provide EGR for quick warm-up of the engine. The opening of the intake valve 16 at 106 and the large valve overlap 104 allow hot exhaust gas to pass through the cylinder 12 to the intake manifold 17 and mix with the incoming air. A warmer charge enters the cylinder 12 during the intake stroke 102.

The braking operation of the I.C. engine of the present invention has two integral components: a bleeder-compression release (bleeder) braking, or engine braking, provided by the variable valve actuation system 20 and the exhaust brake 44, and an exhaust braking provided by the exhaust brake 44. The bleeder-compression release brake component is provided by combined action of both the hydraulic extension device 70*a* of the exhaust rocker assembly 24 and the exhaust brake 44, while the exhaust brake component is provided solely by the exhaust brake 44.

During the engine braking operation, when it is determined by the electronic controller 60 based on the information from the plurality of sensors 62 that the braking is demanded, such as when a throttle valve (not shown) of the engine 10 is closed, the exhaust brake 44 is actuated by at least partially closing the butterfly valve 45 in order to create a backpressure resisting the exit of the exhaust gas during the exhaust stroke. Based on the operating demand of the I.C. engine 10, the following operating modes of the variable valve actuation system 20 of the present invention during the engine braking operation may be provided:

1. Operating Mode B-I1. In this mode the electronic controller 60 opens the exhaust control valve 52 and closes the intake control valve 54 to turn on the supply of the pressurized hydraulic fluid to the hydraulic extension device 70*a* and turn off the supply of the pressurized hydraulic fluid to the hydraulic extension device 70*b*, thus setting the hydraulic extension device 70*a* to the pressurized condition, while setting the hydraulic extension device 70*b* to the depressurized condition. This provides reduced lift and phase angle for the intake valve 16 during the intake stroke 102, as shown by the line I1 in FIG. 4. The exhaust brake 44 reads exhaust system pressure and temperature from the sensors 48 at the microprocessor 47 and regulates a signal 49 to the exhaust brake actuator 46 that adjusts the variable exhaust restrictor 45.

When a throttle valve (not shown) of the engine 10 is closed, and engine retarding, or braking, is desired, the exhaust restrictor 45 of the exhaust brake 44 is closed sufficiently by the controller 60, acting through the microprocessor 47 and the exhaust brake actuator 46, to generate a sufficient backpressure in the exhaust manifold 17 acting to a back face of the exhaust valve 15, that is, on a valve stem side thereof, to initiate an opening of the exhaust valve 15 near the end of the intake stroke 102 of the cylinder 12 as illustrated at 108 in FIG. 4. This gas pressure actuated exhaust valve lift is called a valve float. The degree by which the restrictor is closed is determined by the controller 60 to give sufficient pressure to cause the exhaust valve to float. However this is done within designated exhaust pressure and exhaust temperature limits as sensed by the sensors 48 to avoid excess strain or damage to the engine. Preferably, the controller 60 (or 47) includes a lookup table of exhaust pressure values that are sufficient to cause the valve float of the exhaust valves 15, but are below a predetermined maximum pressure value. Further preferably, the controller 60 (or 47) operatively connected to the temperature sensor 48 adjusts the exhaust restrictor 45 so that the exhaust gas temperature remains below a predetermined maximum value. The exhaust brake 44 generates high enough exhaust gas backpressure, even at low engine speeds, so that the system is enabled over the entire range for engine braking. Thus, the valve lift profile 108, which is the reopening of the exhaust valve for engine braking, is provided independent of any cam profile.

Furthermore, as the exhaust valve 15 floats forming a gap between the exhaust valve interface member 90 and the top face 15" of the exhaust valve 15, the hydraulic extension device 70*a* is further expanded to its fully extended position to close this gap between the exhaust valve interface member 90 and the exhaust valve 15 by moving the upper lifter body 76 upwardly, from the point of view of FIG. 2, to its uppermost position, and the additional amount of the pressurized hydraulic fluid enters through the supply conduit 86 and fills the chamber 84. Accordingly, the distance δ of the protrusion 80 extending above the top face 81 of the lower lifter body 72 further increases.

As the exhaust valve 15 returns from floating towards its closed (or seated) position, it is caught and held opened by the expanded hydraulic extension device 70*a* of the exhaust rocker assembly 24 as the check valve 85 hydraulically locks the chamber 84 and the upper lifter body 76 is held firmly in place. In other words, the length of the hydraulic extension device 70*a* in its fully extended position is such that the extension device 70*a* holds the exhaust valve open.

The radial clearance 77 between the upper lifter body 76 and the internal bore 75 in the lower lifter body 72 permits the hydraulic fluid to gradually leak out of chamber 84 with continued upward pressure of the exhaust valve 15 as the cylinder pressure builds up. This permits the exhaust valve 15 to close near the end of the compression stroke as seen at 114 in FIG. 4 due to the leakage of the hydraulic fluid from the chamber 84 through the radial clearance 77. The lost hydraulic fluid is refilled on every engine cycle, thus resetting the hydraulic extension device 70*a* of the exhaust rocker assembly 24 before the next engine cycle. Therefore, sizing of the radial clearance 77 between the upper lifter body 76 and the internal bore 75 in the lower lifter body 72 to allow the hydraulic fluid to leak out of the chamber 84 of the extension device 70*a* at a predetermined rate as required in the engine brake operation of the variable valve actuation system 20 is an important control parameter.

The exhaust valve motion produced by the variable valve actuation system 20 during the brake operation is illustrated by a line B in FIG. 4. The main exhaust event 100 and the main intake event 102 occur at their normal times. When exhaust gas pressure is raised sufficiently in the exhaust manifold 17 by closing the exhaust restrictor 45 of the exhaust brake 44, the backpressure force of the exhaust gas on the back of the exhaust valve 15 overcomes the resisting force of the valve spring 15' and the gas pressure force in the cylinder 12. The exhaust valve reopens (floats) at 108 on the line B. The exhaust valve lift 108 is sufficient to allow high-pressure exhaust gas to flow back from the exhaust manifold 17 and charge the cylinder 12. As the exhaust valve 15 moves away from the valve train, the hydraulic extension device 70*a* of the exhaust rocker assembly 24 is able to expand to its fully extended position. The expanded extension device 70*a* catches the exhaust valve 15 at the lifted position 110 on the line B as it moves back to the closed (or seated) position, and holds it off the valve seat through the remainder of the compression stroke. As cylinder pressure 116 builds up, the hydraulic extension device 70*a* starts pushing back (or contracting) at 112 on the line B and the exhaust valve 15 moves toward its closed position at 114 on the line B.

Thus, an extended open duration lift of the exhaust valve 15 is provided, which forms a bleeder orifice during the engine compression stroke, and the engine 10 performs non-recoverable work as gas is forced out of the cylinder through this orifice, which embodies the bleeder-compression release brake.

The brake performance of the I.C. engine 10 equipped with the variable valve actuation system 20 of the present invention has two components. Bleeder brake work is done during the compression stroke, as gas in the cylinder 12 is forcibly expelled through the partially opened exhaust valve 12 held by the hydraulic extension device 70*a* of the exhaust rocker assembly 24. Exhaust brake work is done during the exhaust stroke 100 as cylinder gas is expelled through the exhaust system against pressure generated by exhaust brake 44.

Therefore, sizing of the radial clearance 77 between the upper lifter body 76 and the internal bore 75 in the lower lifter body 72 to allow the hydraulic fluid to leak out of the chamber 84 of the extension device 70*a* at a predetermined rate as required in the engine brake operation of the variable valve actuation system 20 is an important control parameter.

Alternatively, the hydraulic extension device 70*a* of the exhaust rocker assembly 24 is designed with a smaller clearance 77 between the upper lifter body 76 and the internal bore 75 in the lower lifter body 72 to significantly prevent the hydraulic fluid leak out of the chamber 84 of the extension device 70*a* during the engine brake operation so that the bleeder brake lift 110 on the line B is maintained throughout the engine cycle, as shown on a line B/B' on FIG. 4. In this mode, the only requirement for the hydraulic fluid after the initial fill is the amount needed to replace any small amount of the hydraulic fluid that does leak as the high braking load is applied on each cycle. One aspect of Mode B/B' is that the brake may be turned on over many engine cycles. The brake will also take more engine cycles to evacuate the actuator volume and turn off.

Full compression of the hydraulic extension device 70*a* may occur in the expansion stroke, or in the exhaust stroke under the continued force of the gas pressure in the cylinder 12 and the resilient force of the valve spring 15'. This process repeats each cycle of the engine when valve float occurs. During positive power the exhaust restrictor 45 is open and there is no valve float. The hydraulic extension device 70*a* remains under load throughout the engine cycle and cannot expand to hold the exhaust valve 15 off its seat. Thus, the engine brake is disabled.

2. Operating Mode B-I2. In this mode the electronic controller 60 opens both the exhaust control valve 52 and the intake control valve 54 to turn on the supply of the pressurized hydraulic fluid to both of the hydraulic extension devices 70*a* and 70*b*, thus setting the hydraulic extension devices 70*a* and 70*b* to the pressurized condition. This provides the extended lift and phase angle for the intake valve 16 during the intake stroke 102, as shown by the line I1 in FIG. 4. The lift profile of the exhaust valve 15 is substantially identical to the same during the Operating Mode B-I1. The reduced intake will substantially limit cylinder charging from the intake manifold. Therefore, Mode B-I1 may be used to provide a lower level of braking power.

Figure 5:
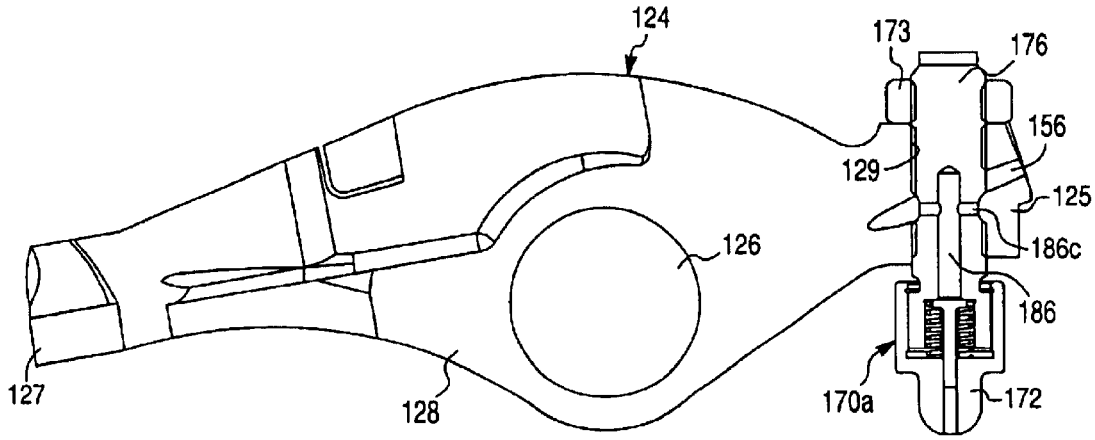
FIG. 5 is a sectional view of an exhaust rocker assembly in accordance with a second exemplary embodiment of the present invention.
Figure 6:
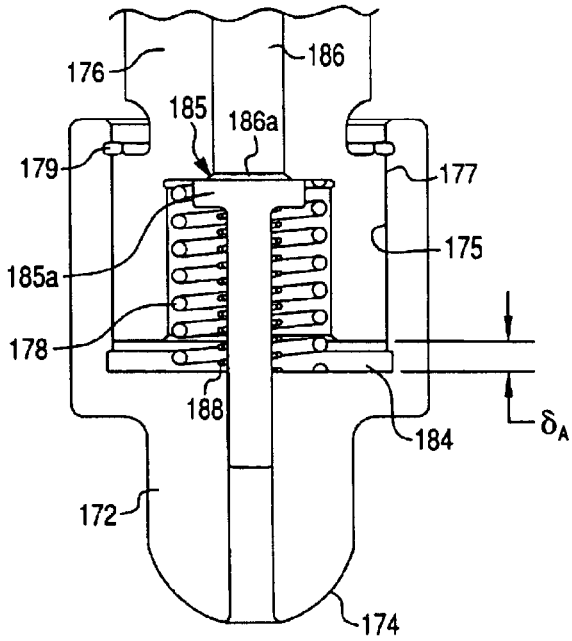
FIG. 6 is a partial sectional view of a hydraulic extension device of the exhaust rocker assembly in accordance with the second exemplary embodiment of the present invention.

FIGS. 5 and 6 illustrate a second exemplary embodiment of the exhaust rocker assembly of the variable valve actuation system in accordance with the present invention. To simplify the description, components that are similar to, or function in the same way as in the first exemplary embodiment depicted in FIGS. 1–4 are labeled with the reference numerals 100 higher, sometimes without describing in detail since similarities between the corresponding parts in the two embodiments will be readily perceived by the reader.

The second exemplary embodiment of the exhaust rocker assembly, generally designated by the reference numeral 124 includes a hydraulic extension device 170*a* illustrated in detail in FIG. 6. The variable valve actuation system in accordance with the second exemplary embodiment of the present invention may include an intake rocker assembly. Preferably, in accordance with the second exemplary embodiment of the present invention, exhaust and intake rocker assemblies and respective hydraulic extension devices are substantially identical. Thus, only the exhaust rocker assembly 124 and its respective hydraulic extension device 170*a* are shown in FIGS. 5 and 6. It will be appreciated that alternatively only the exhaust rocker assembly 124 may be provided with the hydraulic extension device.

The exhaust rocker assembly 124, as shown in FIG. 5, comprises an exhaust rocker lever 128 rotatably mounted on the exhaust rocker shaft 126. The I.C. engine incorporating the variable valve actuation system in accordance with the second exemplary embodiment of the present invention includes a pushrod (not shown) actuating the exhaust rocker assembly 124 and driven by the exhaust cam member 11 (not shown in FIG. 5). The exhaust rocker lever 128 has a first end 125 located adjacent to the pushrod, and a second end 127 provided to operatively engage the exhaust valve 15 (not shown in FIG. 5).

The hydraulic extension device 170*a* in accordance with the second exemplary embodiment of the present invention, is installed at the first end 125 of the exhaust rocker lever 128 so that the hydraulic extension device 170*a* is disposed in the exhaust valve drive train on a camshaft side of the engine, and is operatively coupled to the pushrod. The hydraulic extension device 170*a* defines a hydraulically expandable linkage placed in the exhaust valve drive train between the exhaust rocker lever 128 and the pushrod.

The hydraulic extension device 170*a* comprises a lower lifter body 172 and an upper lifter body 176 reciprocatingly mounted within a bore 175 in the lower lifter body 172 with a radial clearance 177 there between. The lower lifter body 172 has a ball-like end 174 for being received in a socket (not shown) coupled to a top end of the pushrod. The upper lifter body 176 is threadedly mounted within a threaded bore 129 in the first end 125 of the exhaust rocker assembly 124 and fastened in place by a locknut 173, thus functioning as an adjusting screw. A retaining ring 179 holds the upper lifter body 172 from leaving the bore 175 in the lower lifter body 172, which is biased to push against the retaining ring 179 by a coil spring 178. The retaining ring 179 is provided to limit upward movement of the upper lifter body 176 relative to the lower lifter body 172 from the point of view of FIGS. 5 and 6. Axial dimensions of the lower and upper lifter bodies 172 and 176 and the thickness and location of the retaining ring 179 establish a gap $\delta_A$ between the lower and upper lifter bodies 172 and 176.

The hydraulic extension device 170*a* further defines a variable volume hydraulic chamber 184 formed within the bore 175 between the lower and upper lifter bodies 172 and 176. A check valve 185 is incorporated into the extension device 170*a* to hydraulically isolate the hydraulic chamber 184 by using a plunger 185*a* biased by a coil spring 188 to seal against a hydraulic fluid supply conduit 186 formed longitudinally through the upper lifter body 176 including an exit opening 186*a* and at least one intake conduit 186*c*.

The pressurized hydraulic fluid fills the hydraulic chamber 184 by way of the supply conduit 186 through the intake conduit 186*c*. As long as the pressure of the hydraulic fluid supplied to the chamber 184 is greater than the pressure of the fluid in the chamber 184, the plunger 185*a* of the check valve 185 indexes to allow the pressurized hydraulic fluid into the chamber 184. Once the pressure of the hydraulic fluid in the chamber 184 is greater than the pressure of the hydraulic fluid from the source 50, the check valve 185 hydraulically locks the chamber 184 and the gap $\delta_A$ is held firmly open. The radial clearance 177 is a flow path for the hydraulic fluid to leak out of the hydraulically locked chamber 184. This radial clearance 177 is designed to allow the hydraulic fluid to leak out at a predetermined rate as required in the engine brake operation of the variable valve actuation system in accordance with the present invention.

The supply conduit 186 provides fluid communication between the hydraulic chamber 184 of the hydraulic extension device 170*a* and a fluid channel 156 within the exhaust rocker lever 128, which, in turn, is fluidly connected to the source 50 of the pressurized hydraulic fluid through the solenoid-operated exhaust control valve 52. Therefore, the hydraulic chamber 184 is adapted to be selectively connected and disconnected with the source 50 of the pressurized hydraulic fluid, thus switching the hydraulic extension device 170*a* between pressurized condition when the control valve 52 is open, and depressurized condition when the control valve 52 is closed.

The operation of the variable valve actuation system in accordance with the second exemplary embodiment of the present invention is substantially similar to the operation of the variable valve actuation system 20 in accordance with the first exemplary embodiment of the present invention. More specifically, during the positive power operation when the variable exhaust restrictor 45 of the exhaust brake 44 remains open, if the electronic controller 60 opens the exhaust and/or intake control valve (52 or 54) to set the exhaust and/or intake hydraulic extension devices in the pressurized condition, the extended lift and phase angle of the engine valves is provided. Conversely, if the electronic controller 60 closes the exhaust and/or intake control valve (52 or 54) to set the exhaust and/or intake hydraulic extension devices in the unpressurized condition, the reduced lift and phase angle of the engine valves is provided.

During the engine braking operation, the electronic controller 60 opens the exhaust control valve 52 to turn on the supply of the pressurized hydraulic fluid to the hydraulic extension device 170*a*, thus setting the hydraulic extension device 170*a* to the pressurized condition. The exhaust brake 44 reads exhaust system pressure and temperature from the sensors 48 at the microprocessor 47 and regulates a signal 49 to the exhaust brake actuator 46 that adjusts the variable exhaust restrictor 45 to generate a sufficient backpressure in the exhaust manifold 17 acting to a back face of the exhaust valve 15, that is, on a valve stem side thereof, to initiate a small opening (floating) of the exhaust valve 15 near the end of the intake stroke 102 of the cylinder 12 as illustrated at 108 in FIG. 4. As the exhaust valve 15 floats forming a gap between the exhaust valve 15 and the second end 127 of the rocker lever 128, the hydraulic extension device 170*a* is further expanded to its fully extended position to close this gap between the exhaust valve 15 and the second end 127 of the rocker lever 128 by moving the lower lifter body 172 away from the upper lifter body 176 to its fully extended position, and the additional amount of the pressurized hydraulic fluid enters through the supply conduit 186 and fills the chamber 184. Accordingly, the distance $\delta_A$ between the lower and upper lifter bodies 172 and 176 further increases. As the exhaust valve 15 returns from floating towards its closed (or seated) position, it is caught and held opened by the expanded hydraulic extension device 170*a* of the exhaust rocker assembly 124 as the check valve 185 hydraulically locks the chamber 184 and the lower lifter body 172 is held firmly in place. In other words, the length of the hydraulic extension device 170*a* in its fully extended position is such that the extension device 170*a* holds the exhaust valve open.

The radial clearance 177 between the lower lifter body 172 and the upper lifter body 176 permits the hydraulic fluid to gradually leak out of chamber 184 with continued upward pressure of the exhaust valve 15 as the cylinder pressure builds up. This permits the exhaust valve 15 to close near the end of the compression stroke as seen at 114 in FIG. 4 due to the leakage of the hydraulic fluid from the chamber 184 through the radial clearance 177. The lost hydraulic fluid is refilled on every engine cycle, thus resetting the hydraulic extension device 170*a* of the exhaust rocker assembly 124 before the next engine cycle. Therefore, sizing of the radial clearance 177 between the lower lifter body 172 and the upper lifter body 176 allows the hydraulic fluid to leak out of the chamber 184 of the extension device 170*a* at a predetermined rate as required in the engine brake operation of the variable valve actuation system 20.

Therefore, the variable valve actuation system in accordance with the present invention represents a novel arrangement of the valve actuation system of the I.C. engine for selectively modally activating engine intake and exhaust valves in a plurality of operating modes during both a positive power operation and an engine braking operation which is an integral element of the variable valve actuation system of the present invention and does not require additional valve actuation apparatus. Moreover, the variable valve actuation system of the present invention enhances power density and fuel economy, and improves exhaust emissions, while being relatively simple, inexpensive in manufacturing, and adapted to be integrated into the overall engine design.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A variable valve actuation system for operating at least one exhaust valve of an internal combustion engine during a positive power operation and an engine braking operation, said system comprising:

an exhaust rocker assembly for operating said at least one exhaust valve, said exhaust rocker assembly driven by an exhaust cam member;

an exhaust hydraulic extension device operatively coupling said exhaust rocker assembly with one of said at least one exhaust valve and said exhaust cam member for controlling a lift and a phase angle of said at least one exhaust valve;

a source of a pressurized hydraulic fluid in fluid communication with said exhaust hydraulic extension device; and an exhaust control valve provided to selectively supply the pressurized hydraulic fluid from said source to said exhaust hydraulic extension device so as to switch said exhaust hydraulic extension device between a pressurized condition when the pressurized hydraulic fluid is supplied to said exhaust hydraulic extension device and a depressurized condition when the pressurized hydraulic fluid is not supplied to said exhaust hydraulic extension device;

said engine having an exhaust brake provided to generate an exhaust backpressure sufficient to cause said at least one exhaust valve to open near a bottom dead center of an intake stroke of the engine during the engine braking operation;

said exhaust hydraulic extension device in said pressurized condition provided to maintain said at least one exhaust valve open during a compression stroke when said engine performs the engine braking operation.

2. The variable valve actuation system as defined in claim 1, wherein said exhaust hydraulic extension device is operatively coupled to said exhaust rocker assembly adjacent to said at least one exhaust valve.

3. The variable valve actuation system as defined in claim 1, wherein said exhaust hydraulic extension device is operatively coupled to said exhaust rocker assembly adjacent to said exhaust cam member.

4. The variable valve actuation system as defined in claim 1, wherein said exhaust hydraulic extension device is a hydraulically expandable linkage including a lower lifter body slidingly mounted within said exhaust rocker assembly and an upper lifter body adapted to reciprocate within said lower lifter body between an expanded position and a collapsed position; said lower lifter body and said upper lifter body define a variable volume hydraulic chamber therebetween.

5. The variable valve actuation system as defined in claim 4, wherein said exhaust rocker assembly further includes a fluid channel providing the pressurized hydraulic fluid from said source to said hydraulic chamber to extend said exhaust hydraulic extension device when there is a gap between said exhaust extension device and said at least one exhaust valve.

6. The variable valve actuation system as defined in claim 4, wherein said exhaust hydraulic extension device further includes a check valve provided to hydraulically lock said hydraulic chamber when a pressure of the hydraulic fluid within said hydraulic chamber exceeds the pressure of the hydraulic fluid from said source.

7. The variable valve actuation system as defined in claim 4, further including means permitting controlled leakage of the pressurized hydraulic fluid from said hydraulic chamber during the compression stroke, said means permitting controlled leakage is calibrated so as to allow said at least one exhaust valve to substantially close near the completion of the compression stroke.

8. The variable valve actuation system as defined in claim 7, wherein said means permitting controlled leakage of the pressurized hydraulic fluid is a radial clearance between said upper lifter body and an internal bore in said lower lifter body.

9. The variable valve actuation system as defined in claim 4, further including means permitting controlled leakage of the pressurized hydraulic fluid from said hydraulic chamber during the compression stroke, said means permitting controlled leakage is calibrated so as to maintain said at least one exhaust valve substantially open throughout the entire engine cycle.

10. The variable valve actuation system as defined in claim 9, wherein said means permitting controlled leakage of the pressurized hydraulic fluid is a radial clearance between said upper lifter body and an internal bore in said lower lifter body.

11. The variable valve actuation system as defined in claim 1, wherein said exhaust brake includes a butterfly valve operated by an exhaust brake actuator.

12. The variable valve actuation system as defined in claim 1, wherein said exhaust brake includes a variably restrictive turbocharger.

13. The variable valve actuation system as defined in claim 1, wherein said exhaust hydraulic extension device maintains said at least one exhaust valve open throughout the compression stroke.

14. The variable valve actuation system as defined in claim 1, further including an electronic controller operatively connected to said exhaust control valve for selectively opening thereof depending on operating demand of the engine and to said exhaust brake so as to adjust said exhaust brake during braking operation of said variable valve actuation system so that the exhaust pressure is sufficient to cause said at least one exhaust valve to open.

15. The variable valve actuation system as defined in claim 14, wherein said electronic controller includes a lookup table of exhaust pressure values which are sufficient to cause said exhaust valve to open, but below a predetermined maximum value.

16. The variable valve actuation system as defined in claim 14, further including a temperature sensor for sensing an exhaust gas temperature, said temperature sensor being operatively connected to said electronic controller, said electronic controller adjusting said exhaust brake so that the exhaust gas temperature remains below a predetermined maximum value.

17. The variable valve actuation system as defined in claim 1, wherein said system provides an extended lift and phase angle of said at least exhaust valve when said exhaust hydraulic extension device in said pressurized condition and a reduced lift and phase angle of said at least exhaust valve when said exhaust hydraulic extension device in said depressurized condition.

18. The variable valve actuation system as defined in claim 17, wherein said extended and reduced lift and phase angle of said at least exhaust valve are provided during said positive power operation.

19. The variable valve actuation system as defined in claim 1, wherein said engine further includes at least one intake valve, an intake rocker assembly driven by an intake cam member for operating said at least one intake valve, an intake hydraulic extension device operatively coupling said intake rocker assembly with one of said at least one intake valve and said intake cam member for controlling a lift and a phase angle of said at least one intake valve and an intake control valve provided to selectively supply the pressurized hydraulic fluid from said source to said intake hydraulic extension device so as to selectively switch said intake hydraulic extension device between a pressurized condition when said pressurized hydraulic fluid is supplied to said intake hydraulic extension device and a depressurized condition when said pressurized hydraulic fluid is not supplied to said intake hydraulic extension device.

20. The variable valve actuation system as defined in claim 19, wherein said system provides an extended lift and phase angle of said at least intake valve when said intake hydraulic extension device in said pressurized condition and a reduced lift and phase angle of said at least intake valve when said intake hydraulic extension device in said depressurized condition.

21. The variable valve actuation system as defined in claim 19, wherein said intake rocker assembly and said intake hydraulic extension device are substantially identical to said exhaust rocker assembly and said exhaust hydraulic extension device.

22. The variable valve actuation system as defined in claim 1, wherein said exhaust brake generates the exhaust backpressure sufficient to cause said at least one exhaust valve to open prior to the bottom dead center of an intake stroke of the engine when said exhaust hydraulic extension device is in said pressurized condition during the engine braking operation.

23. The variable valve actuation system as defined in claim 1, wherein said exhaust hydraulic extension device controls said lift and said phase angle of said at least one exhaust valve during said positive power operation.

24. A method for controlling a variable valve actuation system for operating at least one exhaust valve of an internal combustion engine during a positive power operation and an engine braking operation; said system comprising an exhaust rocker assembly driven by an exhaust cam member for operating said at least one exhaust valve, an exhaust hydraulic extension device operatively coupling said exhaust rocker assembly with one of said at least one exhaust valve and said exhaust cam member for controlling a lift and a phase angle of said at least one exhaust valve, a source of a pressurized hydraulic fluid and an exhaust control valve provided to selectively supplying the pressurized hydraulic fluid from said source to said exhaust hydraulic extension device so as to selectively switch said exhaust hydraulic extension device between a pressurized condition and a depressurized condition; said engine having an exhaust brake; said method comprising the steps of:

a) determining an operating mode demanded;

b) if the braking operation is demanded then:

1) opening said exhaust control valve to set said exhaust hydraulic extension device in said pressurized condition;

2) adjusting said exhaust brake to generate an exhaust backpressure sufficient to cause said at least one exhaust valve to open near a bottom dead center of an intake strokes of said engine; and 3) maintaining said at least one exhaust valve open during a compression stroke when said engine performs the engine braking operation;

c) if the positive power operation is demanded then:

1) determining a lift and phase angle of said at least exhaust valve demanded;

2) opening said exhaust control valve to set said exhaust hydraulic extension device in said pressurized condition if an extended lift and phase angle of said at least one exhaust valve is demanded; and 3) closing said exhaust control valve to set said exhaust hydraulic extension device in said depressurized condition if a reduced lift and phase angle of said at least one exhaust valve is demanded.

25. The method for controlling said variable valve actuation system as defined in claim 24, wherein said engine further includes at least one intake valve, an intake rocker assembly driven by an intake cam member for operating said at least one intake valve, an intake hydraulic extension device operatively coupling said intake rocker assembly with one of said at least one intake valve and said intake cam member for controlling a lift and a phase angle of said at least one intake valve and an intake control valve provided to selectively supply the pressurized hydraulic fluid from said source to said intake hydraulic extension device so as to selectively switch said intake hydraulic extension device between a pressurized condition and a depressurized condition; said method further comprising the steps of:

opening said intake control valve to set said intake hydraulic extension device in said pressurized condition if an extended lift and phase angle of said at least intake valve is demanded; and closing said intake control valve to set said intake hydraulic extension device in said depressurized condition if a reduced lift and phase angle of said at least intake valve is demanded.

* * * * *